350-336 SR
PFR34 XR 4,198,810

United States Patent [19]
Fahrenschon

[11] 4,198,810
[45] Apr. 22, 1980

[54] ANALOG-DIGITAL CHRONOMETRIC DISPLAY

[75] Inventor: Kurt Fahrenschon, Kelkheim, Fed. Rep. of Germany

[73] Assignee: Braun AG, Frankfurt am Main, Fed. Rep. of Germany

[21] Appl. No.: 921,007

[22] Filed: Jun. 30, 1978

[30] Foreign Application Priority Data

Jul. 2, 1977 [DE] Fed. Rep. of Germany ..... 2730069

[51] Int. Cl.[2] ..... G04B 19/30
[52] U.S. Cl. ..... 368/239; 368/240; 368/242; 340/765
[58] Field of Search ..... 340/336, 765, 784; 58/50 R, 23 R, 127 R; 350/160 LC

[56] References Cited

U.S. PATENT DOCUMENTS

| | | | |
|---|---|---|---|
| 3,626,410 | 12/1971 | deKoster | 58/23 R X |
| 3,772,874 | 11/1973 | Lefkowitz | 58/50 R |
| 3,823,549 | 7/1974 | Feldman | 58/50 R |
| 3,911,665 | 10/1975 | Van Berkum | 58/50 R |
| 3,958,409 | 5/1976 | Manber | 58/50 R |
| 3,959,963 | 6/1976 | Murrell | 58/50 R |
| 3,987,617 | 10/1976 | Slob | 58/50 R |
| 3,992,875 | 11/1976 | Kashio | 58/23 R X |
| 4,077,032 | 2/1978 | Volkman | 58/50 R X |
| 4,081,953 | 4/1978 | Crutcher | 58/50 R |
| 4,095,405 | 6/1978 | Tanaka | 58/23 R X |

*Primary Examiner*—Ulysses Weldon
*Attorney, Agent, or Firm*—Karl F. Ross

[57] ABSTRACT

A chronometric indicator has a multidigit display each of whose digits is formed by a plurality of individually energizable digit segments having respective digit-segment connections and having a common digit-display connection so that simultaneous energization of the common connection with any of the digit-segment connections will optically activiate the respective digit segments. An annular array of sixty angularly equispaced analog display segments surrounds the multidigit display and has an analog-segment connection for each part and inner and outer rings subdividing the analog display segments into inner and outer parts. Simultaneous energization of the inner or outer rings and one of the analog-segment connections will optically activate the corresponding inner or outer part. Each of the digit-display connections is connected to a respective one of the analog display segments. A sequencer is connected to the rings and all of the connections and in the first part of a three-part cycle energized the outer ring and one of the analog segment connections to display the minute, in the second part it energizes the ring and one of the analog segment connections to display the hour, and in the third part energizes the common connection of the multidigit display and several of the analog segment connections to form a digital display of the second.

5 Claims, 3 Drawing Figures

ANALOG-DIGITAL CHRONOMETRIC DISPLAY

FIELD OF THE INVENTION

The present invention relates to a timepiece. More particularly, this invention concerns an electronic chronometric indicator for a timepiece.

BACKGROUND OF THE INVENTION

The so-called digital watches are often found objectionable because their digital displays are difficult to read. Even though a digital display gives very accurate information, this information is not as easy to interpret as the information conveyed by a pair of watch hands which can be read at a glance. It has therefore been suggested to provide an electronic timepiece having a digital readout with a partially analog display. This is provided in the simplest arrangement by providing on the watch face an annular array of sixy angularly equispaced analog display segments which each have inner and outer parts. The inner parts are all juxtaposed with an inner common analog connection ring and the outer parts with an outer common analog connection ring. Thus if the inner ring is energized simultaneously with any of the analog-segment connections assigned to the respective analog display segments respective inner part is optically activated, and the same occurs with the outer part if the outer ring is energized simultaneously with the respective analog-segment connection. With such a system it is therefore possible to display small dots or bars on the outer surface of the watch corresponding to the positions minute and second hands would have on a conventional watch. Of course, such an arrangement can be combined with a digital display that can also be activated for stop-watch functions, to display the date, or to display the seconds.

In German patent publication No. 2,451,057, an arrangement is shown which can only display a limited amount of information, as the analog segments extend all the way to the center of the watch. A liquid-crystal arrangement is employed in the system of German patent publication No. 2,410,527 that has sixty outer segments and twelve inner segments, and which also has a flat digital display. Such an arrangement requires an inordinate amount of connections to display the time completely, and correspondingly requires relatively complex control circuitry.

Yet another system is known from German patent publication No. 2,260,057, wherein 132 connections must be made to indicate the seconds as well as the minutes and hours. The necessary binary/decimal converter is relatively complex in this arrangement, so that the cost thereof as well as the likeliness of the circuit failure are increased.

OBJECTS OF THE INVENTION

It is therefore an object of the present invention to provide an improved chronometric display for a timepiece.

Another object is to provide such a display that can be produced at relatively low cost and which is correspondingly relatively simple.

A further object is to provide a combined analog-digital display which shows the hours and minute in analog fashion and the seconds in digital fashion, all simultaneously.

SUMMARY OF THE INVENTION

These objects are attained in accordance with the instant invention in a chronometric display having in addition to the annular analog display described above with each of the display segments subdivided into inner and outer parts associated with respective rings, a multidigit display having a plurality of digits each subdivided into a plurality of individually energizable digit segments having respective digit-segment connections each connected to a respective analog-segment connection. The multidigit display also has a common connection so that energization of the common connection simultaneously with energization of any of its segment connections optically activates the respective digit segment. Such an indicator can therefore display the hour, minute, and second, even in a twenty-four hour display, using only sixty-three connections to the indicator. Such an indicator also includes sequencing means which is connected to all of these sixy-three connections and which is operable in a first phase to energize the inner ring simultaneously with the selected one of the analog-segment connections, in a second phase to energize the outer ring simultaneously with the selected one of the analog-segment connections, and in a third phase to energize the common connection of the digital display with selected ones of the digit-segment connections for displaying the time.

According to this invention the analog segments number sixty are anularly equispaced, and surround the digit display. The sequencing means runs through the first, the second, and the third phases each second. Such a system therefore allows the outer ring to be used to display the minute, the inner ring to be used to display the hour, and the digital display to indicate the second. Thus at a glance the user can determine the hour and the minute as in a conventional analog watch. Of course, the display is illuminated so that such a watch can be easily read even at night, and the high accuracy and attractive appearance of an electronic timepiece is retained.

SPECIFIC DESCRIPTION

Figure 1:
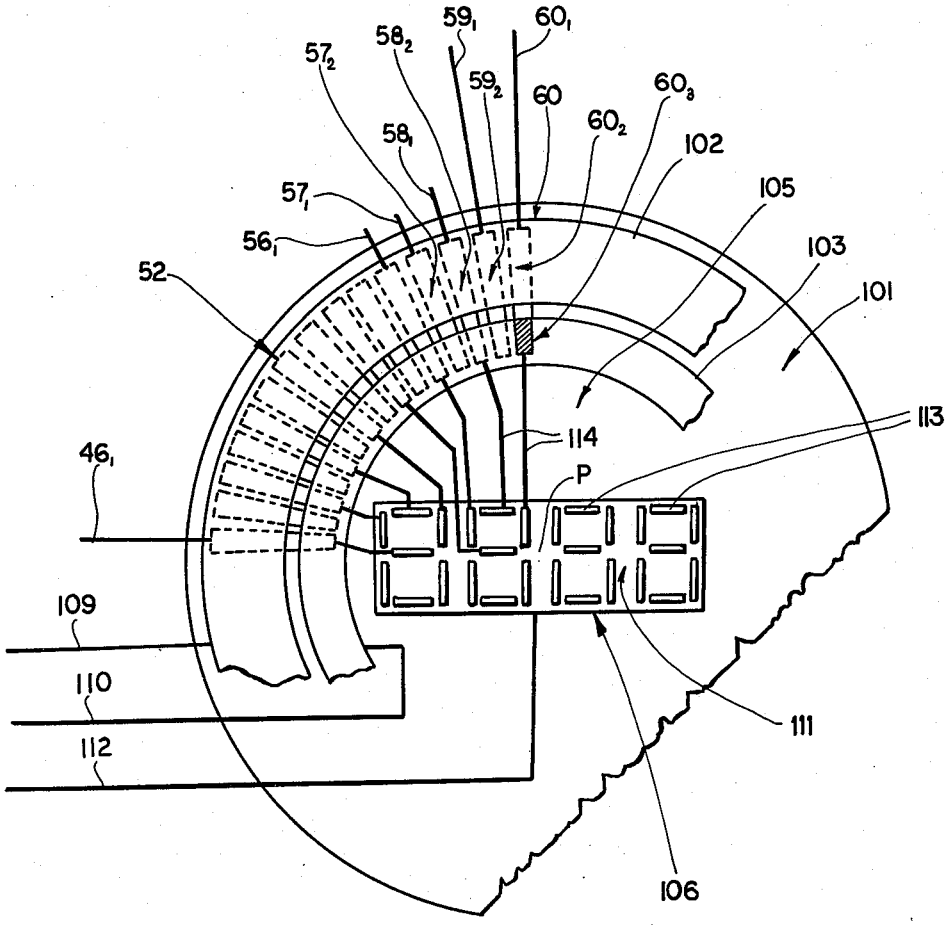
FIG. 1 is a top view of a portion of the display according to this invention.

According to the instant invention a timepiece display as shown in FIG. 1 has a circular support disk 101 centered on a point P and carrying sixty angularly equispaced and radially extending bars or segments 1–60 of which only a portion are shown in FIG. 1. These segments 1–60 have respective connections $\mathbf{1_1}$–$\mathbf{60_1}$ and are subdivided into respective outer parts $\mathbf{1_2}$–$\mathbf{60_2}$ and inner parts $\mathbf{1_3}$–$\mathbf{60_3}$. An outer ring 102 having a connection 109 covers the outer parts $\mathbf{1_2}$–$\mathbf{60_2}$ of the segments 1–60 and another ring 103 having a connection 110 covers the inner parts $\mathbf{1_3}$–$\mathbf{60_3}$.

In addition, inside the inner ring 103 there is formed an open space 105 provided with a four-digit display 106 having a rectangular plate electrode 111 provided with a connection 112, and having a plurality of segments 113 arrayed in groups of seven each capable of representing a single digit. Each of these digit segments 113 is connected via a respective conductor 114 to one of the analog segments 1–60. There need be no particular relationship between the digit segments 113 and the analog segments 1–60. In the instant case a four-digit display 106 is employed, having twenty-eight segments 113 each connected to a respective segment 1–60. This leaves thirty-two of the segments 1–60 unconnected. It is within the scope of this invention to provide an eight-digit display therefore having fifty-six segments, still leaving four of the segments 1–60 unconnected. It is also possible to use a more complex display for full alphanumeric readout.

The segments 1–60 are liquid-crystal material that glow when electrically energized. Thus as shown in FIG. 1 when the connection $60_1$ is energized simultaneously with the ring 103 the inner part $60_3$ will glow. Simultaneous energization of the connection 112 will also energize the respective segment 113 of the display 106.

According to this invention the entire device is operated by means of a clock 115 connected to a sequencer 116 in turn connected to the connections $1_1$–$60_1$, 109, 110, and 112. The sequencer is operated by the clock so as automatically every second to generate three pulses, one on the line 109, one on the line 110, and one on the line 112. During the generation of the pulse on the line 109 which is connected to the outermost ring 102 that in turn is used to display minutes the sequencer energizes that one of the connections $1_1$–$60_1$ corresponding to the minute to be indicated so as to cause the corresponding one of the outer parts $1_2$–$60_2$ to glow. During generation of the pulse on the line 110 connected to the hour ring 103 a pulse is once again also fed to one of the connections $1_1$–$60_1$ to cause one of the inner parts $1_3$–$60_3$ to glow. During the third phase of the one-second cycle during which a pulse is fed to the line 112 by the sequencer 116 pulses are fed to several of the connections $1_1$–$60_1$ to illuminate the corresponding segments 113 of the display 106.

Figure 2:
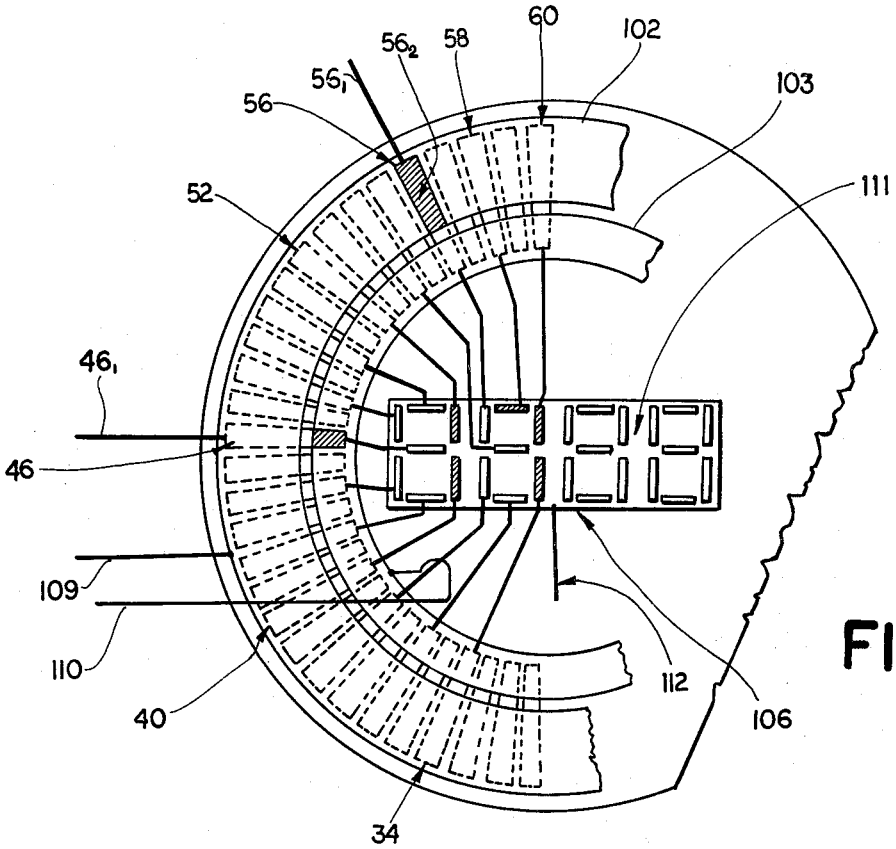
FIG. 2 is a view similar to FIG. 1 showing the display activated for a time of eight hours, fifty-five minutes, and seventeen seconds.
Figure 3:
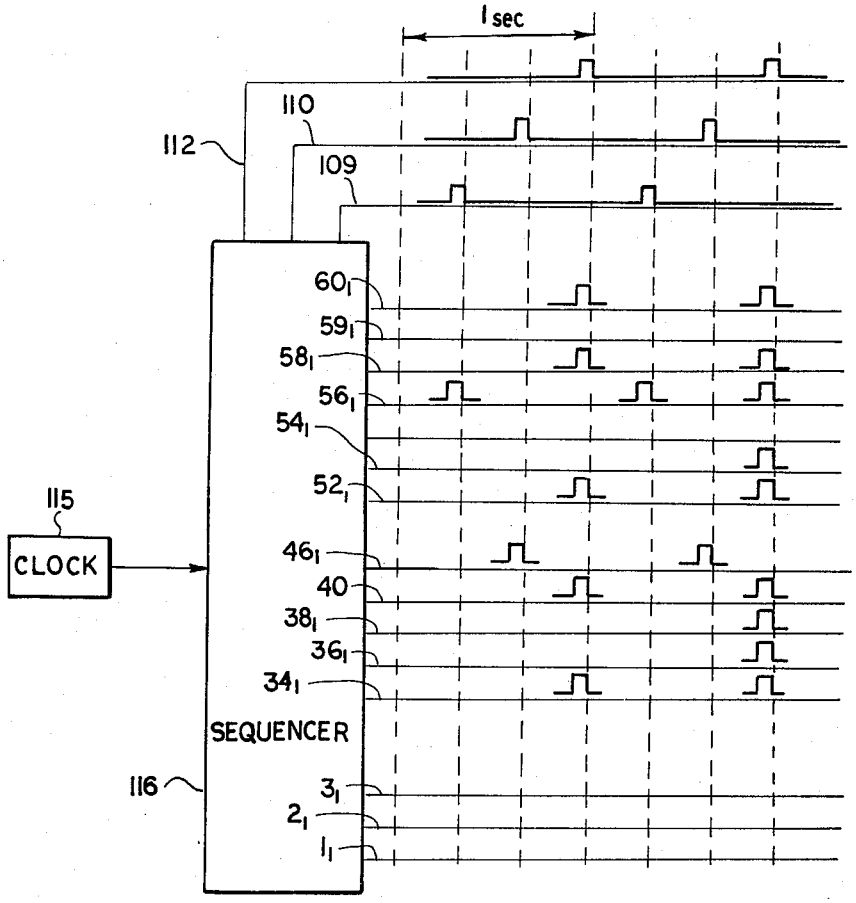
FIG. 3 is a schemmatic-pulse diagram illustrating the operation of the display as shown in FIG. 2.

More particularly as shown in FIGS. 2 and 3 to represent the time of 8 hours, 55 minutes, and 17 seconds those parts of the segments 1–60 are illuminated which would correspond to the positions occupied by the hour and minute hands of a watch at this time, that is the hour hand would be virtually at nine o'clock and the minute hand would be a tiny bit past the 55-minute mark. Thus when a pulse is generated on the line 109 in the first phase of the cycle a pulse is simultaneously generated on the connection $56_1$ to cause the outer part $56_2$ to glow. During the second phase of the cycle a pulse is generated on the line 110 and simultaneously on the line $46_1$. During the third phase of the cycle a pulse is generated on the line 112 and pulses are fed to each of the lines $34_1$, $40_1$, $52_1$ $58_1$ and $60_1$ so as to illuminate those segments 113 which will give a reading of 17.

During the next second the sequence is identical except that four more of the segments 113 are energized in the third phase during energization of the line 112. More particularly, the segments 113 connected through the segments 36, 38, 54, and 56, are energized also to display an 8 instead of a 7.

Thus so that the display according to this invention can use a relatively small number, here sixty-three connections so as to form a highly readable analog hour and minute display and a digital second display. This is simplification in the basic time-indicating display allows other functions to be assigned to the timepiece, as for instance a date display or a stopwatch function.

I claim:

1. A chronometric indicator comprising:

a multidigit display having a plurality of digits each subdivided into a plurality of individually energizable digit segments having respective digit-segment connections and having a common connection, whereby energization of said common connection simultaneously with any of said segment connections optically activates the respective digit segment;

an annular array of generally equispaced analog display segments having respective analog-segment connections and each having respective inner and outer parts, an inner common analog connection ring at said inner parts, and radially spaced from said inner ring an outer common analog connection ring at said outer parts, whereby energization of said inner ring simultaneously with any of said analog-segment connections optically activates the respective inner part and energization of said outer ring simultaneously with any of said analog-segment connections optically activates the respective outer part, each of said digit-segment connections being connected to a respective analog-segment connection; and sequencing means connected to all of said connections and to both of said rings and operable in a first phase to energize said inner ring simultaneously with a selected one of said analog-segment connections, in a second phase to energize said outer ring simultaneously with a selected one of said analog-segment connections, and in a third phase to energize said common connection of said digital display with selected ones of said analog-segment connections for displaying the time.

2. The chronometric indicator defined in claim 1 wherein said segments include liquid-crystal material which illuminates when electrically energized.

3. The chronometric indicator defined in claim 1 wherein each of said digits has seven such digit segments.

4. The chronometric indicator defined in claim 1 wherein said multidigit display has four such digits.

5. A chronometric display comprising:

a multidigit display having a plurality of digits each subdivided into a plurality of individually energizable digit segments having respective digit-segment connections and having a common connection, whereby energization of said common connection simultaneously with any of said digit-segment connections optically activates the respective digit segment;

an annular array of sixty angularly equispaced analog display segments having respective analog-segment connections and each having respective inner and outer parts, said array surrounding said digit display and each of said digit-segment connections being connected to a respective analog-display segment;

an inner common analog connection ring at said inner parts;

an outer common analog connection ring spaced from said inner ring and said outer parts, whereby energization of said inner ring simultaneously with any of said analog-segment connections optically activates the respective inner part and energization of said outer ring simultaneously with any of said analog-segment connections optically activates the respective outer part; and sequencing means connected to said analog-segment connections and through said analog-segments to said digital-segment connections, to said common connection of said digit display, and to both of said rings and operable in a first hour-indicating phase to energize said inner ring simultaneously with a selected one of said analog-segment connections, in a second minute-indicating phase to energize said outer ring simultaneously with a selected one of said analog-segment connections, and in a third second-indicating phase to energize said common connection of said digit display with selected ones of said analog-segment connections for displaying the time, said means stepping through said phases once each second.

* * * * *